United States Patent [19]

Meyer

[11] Patent Number: 4,936,460

[45] Date of Patent: Jun. 26, 1990

[54] VACUUM PACKED STUFFED TOY

[76] Inventor: Boyd L. Meyer, 41 W. 429 Forest La., Elburn, Ill. 60119

[21] Appl. No.: 158,933

[22] Filed: Feb. 22, 1988

[51] Int. Cl.[5] ..... B65D 81/20

[52] U.S. Cl. ..... 206/524.8; 446/75; 53/405

[58] Field of Search ..... 206/524.8, 44.15; 446/75; 53/405

[56] References Cited

U.S. PATENT DOCUMENTS

| | | | |
|---|---|---|---|
| 1,458,585 | 6/1923 | McCrosson | 206/524.8 |
| 3,458,966 | 8/1969 | Dunbar et al. | 206/524.8 |
| 3,958,693 | 5/1976 | Greene | 206/524.8 |
| 4,150,744 | 4/1979 | Fennimore | 206/524.8 |
| 4,662,521 | 5/1987 | Moretti | 206/524.8 |
| 4,767,004 | 8/1988 | Ishihara et al. | 206/524.8 |

*Primary Examiner*—Joseph Man-Fu Moy
*Attorney, Agent, or Firm*—Edmond T. Patnaude

[57] ABSTRACT

This invention relates to a new package for soft toys. The toys are compressed in the direction from front to back to twenty percent or less of their uncompressed thickness, and they are held in compression between front and rear plastic sheets between which a vacuum is maintained. The front sheet is transparent, and the toys are designed and constructed so as to be recognizable when viewed through a transparent plastic sheet.

4 Claims, 3 Drawing Sheets

VACUUM PACKED STUFFED TOY

The present invention relates in general to a new and improved method of packaging compressible soft toys, and it relates more particularly to a package for soft toys and to a method of vacuum packaging soft toys.

BACKGROUND OF THE INVENTION

Soft stuffed toys such as three dimensional soft and compressible as animal like figures are relatively bulky and thus occupy a substantial amount of shelf space when displayed for sale in retail stores. Also, because of the nature of such toys there is a strong desire on the part of many customers to handle them with a consequent soilage and other damage. To some extent this problem has been alleviated by packaging the toys in individual, protective boxes, but that solution has further increased the size of the article to be displayed.

In addition to the display problem, the relatively large size of these toys and packages has presented additional problems in warehousing, shipment and distribution.

SUMMARY OF THE INVENTION

Briefly, in accordance with the present invention there is provided a new and improved method of packaging soft compressible toys as well as a new and improved package for soft toys. The toys are compressed in the direction from front to back to twenty percent or less of their uncompressed thickness, and they are held in compression between front and rear plastic sheets between which a vacuum is maintained. The front sheet is transparent, and the toys are designed and constructed so as to be recognizable when viewed through a transparent plastic sheet. The toys are designed to have a single front fabric panel in which facial characteristics such as eyes, nose and mouth are imprinted so that the front of the compressed toys retain their essentially same appearance when viewed through the transparent front sheet. Each soft toy includes a soft compressible filler material partially compressed between the single, front fabric sheet on which the characteristic features are printed and a rear fabric sheet. The filling or stuffing is a compressible material having a good memory, such for example, as polyester foam.

In order to remove the compressed toy from the package, the front and back sheets are cut open or torn apart to relieve the vacuum and thereby permit the compressed stuffing material and the toy to expand to its original shape when removed from the package.

Preferably, the individually packaged toys are shipped and displayed in a container which holds several of the individual packages and one unpackaged toy which may be affixed to the display container.

In accordance with another feature of the invention the vacumm packed toys are individually packaged with a mailing envelope on a blister pack card. Each toy carries a message and each vacumm package including a toy is receivable in the envelope for mailing after removal of the package and the envelope from the blister pack card.

GENERAL DESCRIPTION OF THE DRAWINGS

Further objects and advantages and a better understanding of the present invention will be had by reference to the following detailed description taken in connection with the accompanying drawings wherein.

DETAILED DESCRIPTION OF A PREFERRED EMBODIMENT OF THE INVENTION

Figure 1:
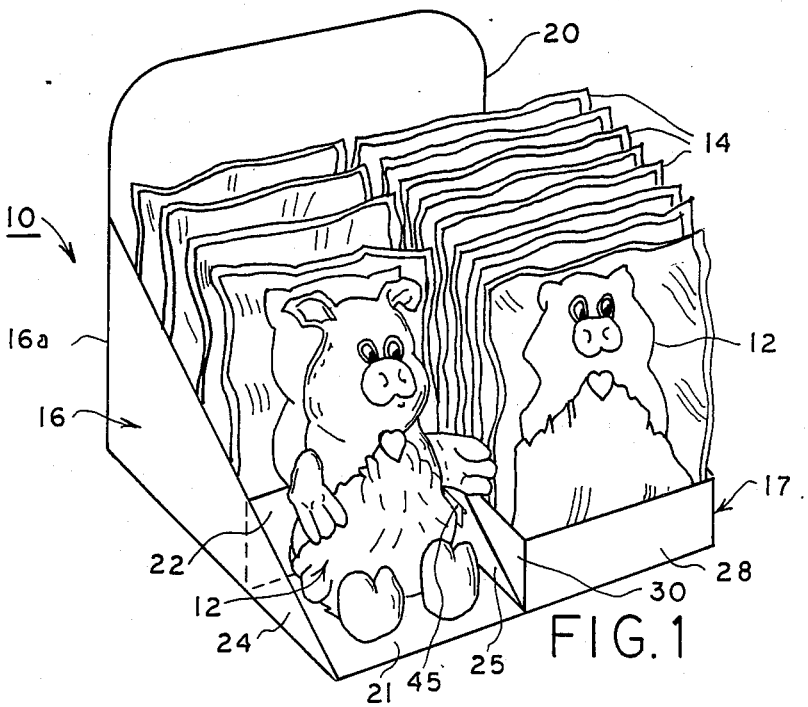
FIG. 1 is a front perspective view of a display of a plurality of vacuum packaged soft toys.
Figure 4:
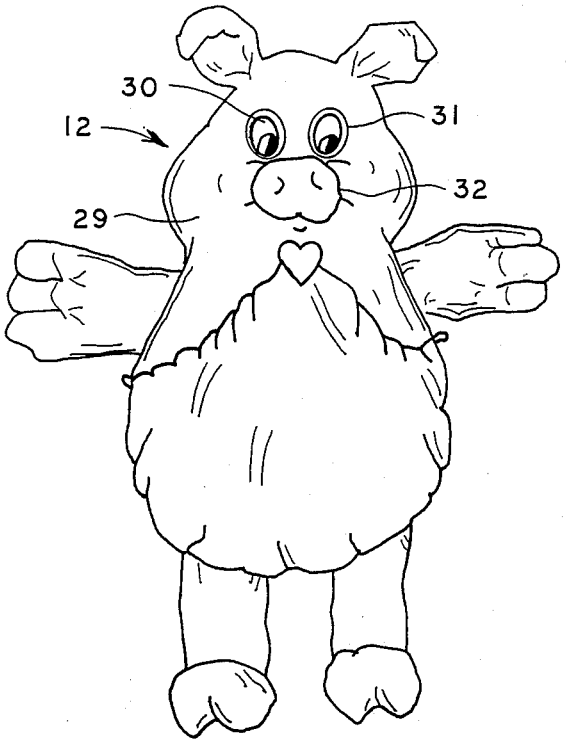
FIG. 4 is a front view of a soft toy after removal thereof from the package of FIG. 2.

Referring to FIG. 1, there is shown a shelf or counter display 10 for display of a soft toy 12 and for holding a plurality of individual packages 14 each containing a soft toy 12 in the compressed state. As more fully described hereinafter, the toy 12 is constituted by a compressible filler or stuffing and a flexible outer skin on which characterizing visual features such as eyes and a nose are printed. The packages 14 each have a transparent, gas impervious front sheet **15*a* and a gas impervious rear sheet 15*b* which are sealed together throughout a continuous area surrounding a soft toy 12 located between the front and rear sheets. The toy 12** in each package is compressed from front to back to twenty percent or less of its unstressed thickness and a vacuum is drawn between the front and rear sheets thereby to hold the toy in the compressed state.

The display 10 may be seen to comprise a pair of trays 16 and 17 located in side-by-side relationship and an upstanding rear wall 20 which extends above the tops of the packages 14 to provide a space for containing descriptive printed matter. The tray 16 has a bottom 21, and upstanding forward wall 22 and a pair of triangular side walls 24 and 25 which extend a short distance forwardly of the front wall 22 and terminate at the front edge of the bottom panel 21. The tray 17 includes a front wall 28 and a pair of side walls 30. As can be seen, the wall 28 is located farther forward than is the wall 22 to provide a section in which one of the toys 12 may be placed in its uncompressed unpackaged state. Preferably, the unpackaged toy is positively secured to the wall 22 to prevent removal thereof from the display.

Figure 2:
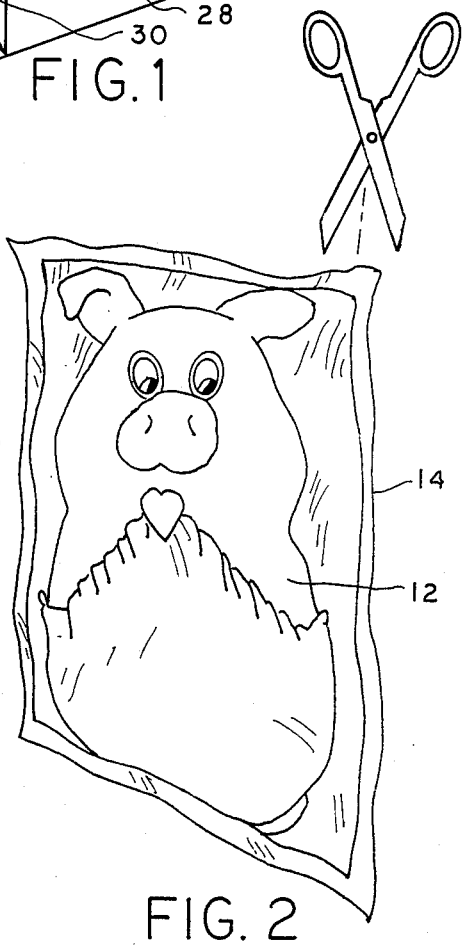
FIG. 2 is a perspective view of a vacuum packaged soft toy.
Figure 3:
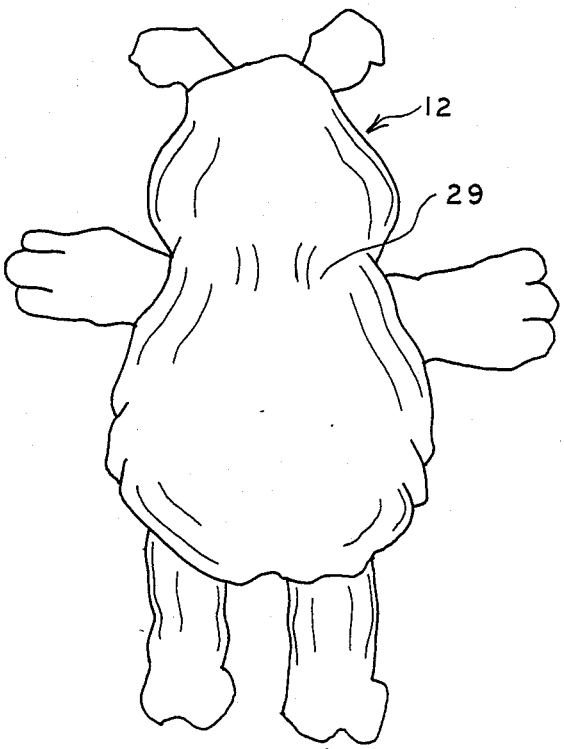
FIG. 3 is a rear view of the soft toy after removal thereof from the package of FIG. 2.
Figure 5:
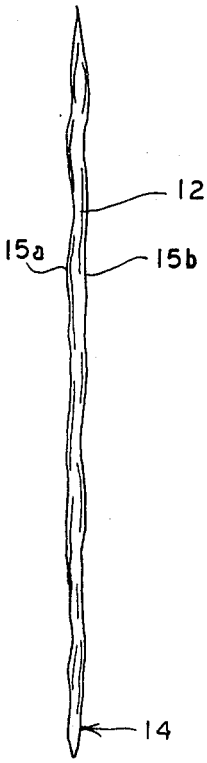
FIG. 5 is a side view of the package of FIG. 2.

An important feature of the packages 14 is the fact that the packaged toy is visible through the front of the package and retain its same general appearance when compressed in the vacuum package. To this end the toy 12 comprises front and rear flexible angles preferably formed of cloth. Characterizing features such as two eyes 30 and 31 and a nose 32 are imprinted on the front panel 29 so that when the toy is compressed from front to back in the package, the front panel and the characterizing features are not distorted. Consequently, as may be seen in FIG. 2, the front side of the toy 12 has the same general appearance when the toy 12 is compressed in the package 14 as it does when it has been removed from the package.

The stuffing or filler may be polyester which has a memory of nearly one-hundred percent and which may be compressed to ten percent or less of its uncompressed volume.

In order to remove a toy 12 from its package 14, the front or rear sheet can be torn or cut with scissors and the toy 12 can then be withdrawn from the package. As the toy is removed from between the front and rear sheets, the filler expands to its original condition and the toy is ready for use.

Figure 6:
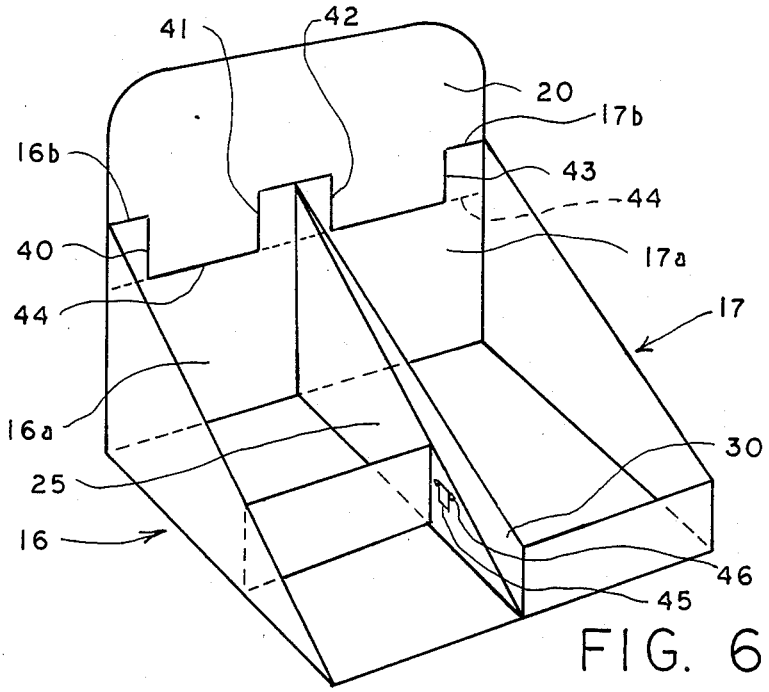
FIG. 6 is a perpsective view of the display of FIG. 1 with the toys removed.

Referring to FIG. 6, it may be seen that the trays 16 and 17 are separate parts which are connected together by the back panel member 20. The panel 20 is provided with four vertical slits 40, 41, 42 and 43 which extend upwardly from the bottom edge 44 of the panel. The panel 20 is positioned against the back sides of the rear walls 16*a* and 17*a* of the trays 16 and 17 and the portions therof between the slits 40, 41 and 42, 43 extend downwardly on the front sides of the walls 16*a* and 17. The upper edges of the rear walls 16*a* and 17*a* are identified by the respective reference numbers 16*b* and 17*b*. Consequently, the trays 16 and 17 are interlocked together by the rear panel 20. If desired an additional fastener means 45, such as a tab 45 on the wall 30 which extends through a slit 46 in the wall 25, may be used to inerconnect the sidewalls 25 and 30 together near the front ends thereof.

Figure 7:
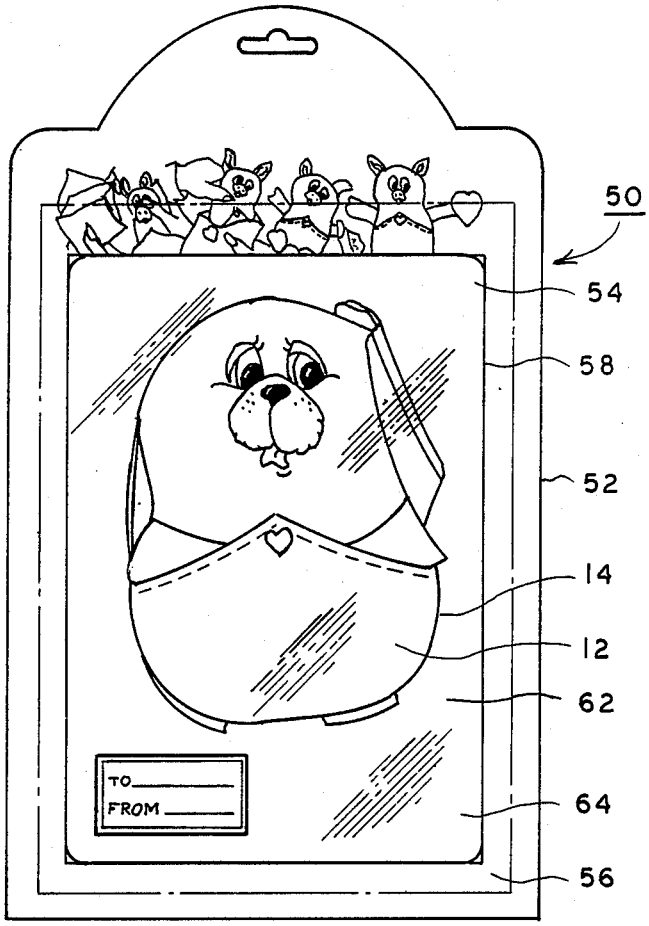
FIG. 7 is a front view of another package containing a soft toy.
Figure 8:
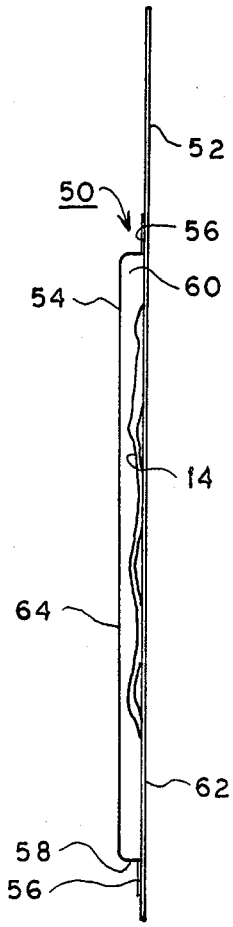
FIG. 8 is a side elevational view of the package shown in FIG. 7.

Referring to FIGS. 7 and 8 there is shown another package for the soft toy 12. This package is generally identified by the reference character 50 and includes a card 52 to which a preformed transparent plastic member 54 is bonded. More particularly, the member 54 includes a peripheral flange 56 which is thermobonded to the front face of the card 52.

The member 54 has a tray-like central section which has a rectangular periphery 58 and together with the card 52 encloses a cavity 60 which is rectangular in cross-section. A mailing envelope 62 and one of the packages 14 is disposed within the cavity 60 between the envelope 62 and the planar front face 64 of the transparent member 54.

Figure 9:
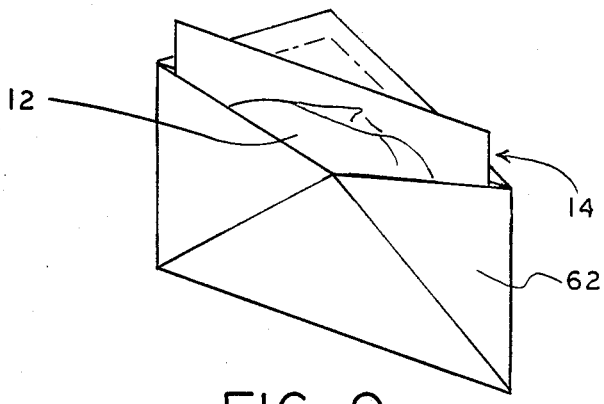
FIG. 9 is a perspective view showing a vacuum packaged soft toy being inserted into a mailing envelope.

A message bearing media may be carried by the toy 12 within the package 14 and suitable messages may be imprinted on the front face of the card 52. The envelope 62 is a conventional mailing envelope as used, for example, for mailing greeting cards and the package 14 is sized to fit within the envelope as shown in FIG. 9.

In use, the purchaser of the package 50 may tear open the blister, remove the package 14 and the envelope 62. Then the envelope may be addressed and the package 14 inserted therein for mailing. The receipient will then open the envelope, remove the package 14 and tear or cut open the package 14 to remove the compressed toy 12. Upon removal of the toy 12, the stuffing in the toy returns to its original state. The message carried by the toy can then be read by or to the receipient.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of the present invention.

What is claimed:

1. A method of packaging a three dimensional soft toy having a compressible resilient filler enclosed in a fabric-like, flexible cover including a flat rear sheet and a flat front sheet on the outside surface of which two dimensional visual facial characteristics are printed, comprising the steps of providing two gas impervious flexible cover sheets, at least one of said cover sheets being transparent, positioning said toy between said sheets with said flat sheet and said visual facial characteristics juxtaposed with said at least one of said sheets, compressing said toy in a direction perpendicular to said front and rear sheets to a thickness of twenty-percent or less of the unstressed thickness of said toy, reducing the pressure between said cover sheets relative to the pressure on the exterior of said sheets by evacuating gas from the space between said cover sheets, and hermetically sealing said cover sheets together throughout a continuous area surrounding said toy, whereby said toy is maintained in a compressed state with said front sheet and said facial characteristics being substantially undistorted and visible through said transparent cover sheet.

2. A method according to claim 1 wherein said filler has a memory characteristic of at least ninety-five percent.

3. A method according to claim 2 wherein said toy is an animal figure including a face, two arms and two legs.

4. An article of manufacture, comprising a three-dimensional toy having a compressible, resilient filler enclosed in a flexible cover including a flat rear sheet and a flat front sheet to the outside surface of which two dimensional facial characteristic are affixed, a plurality of cover sheets of gas impervious material, at least one of said cover sheets being flexible, and at least one of said cover sheets being transparent, said toy being disposed between said cover sheets with said front sheet lying directly against said at least one of said cover sheets which is transparent, said cover sheets being hermetically sealed together throughout a continuous area completely surrounding said toy, said toy being compressed between said front and rear sheets to a thickness of twenty-percent or less of the thickness when said toy is in an unstressed state, and the pressure between said sheets being less than atmospheric pressure to cause said toy to be held in said compressed state between said sheets.

* * * * *